US012708151B2

(12) United States Patent
Sutton

(10) Patent No.: US 12,708,151 B2
(45) Date of Patent: Aug. 18, 2026

(54) VAPOR PROVISION SYSTEM AND CORRESPONDING METHOD

(71) Applicant: Nicoventures Trading Limited, London (GB)

(72) Inventor: Joseph Sutton, London (GB)

(73) Assignee: Nicoventures Trading Limited, London (GB)

( * ) Notice: Subject to any disclaimer, the term of this patent is extended or adjusted under 35 U.S.C. 154(b) by 465 days.

(21) Appl. No.: 17/603,228

(22) PCT Filed: Apr. 9, 2020

(86) PCT No.: PCT/GB2020/050935
§ 371 (c)(1),
(2) Date: Oct. 12, 2021

(87) PCT Pub. No.: WO2020/208367
PCT Pub. Date: Oct. 15, 2020

(65) Prior Publication Data

US 2022/0183386 A1 Jun. 16, 2022

(30) Foreign Application Priority Data

Apr. 12, 2019 (GB) ..... 1905250

(51) Int. Cl.
*A24F 40/53* (2020.01)
*A24F 40/60* (2020.01)

(52) U.S. Cl.
CPC ..... *A24F 40/53* (2020.01); *A24F 40/60* (2020.01)

(58) Field of Classification Search
None
See application file for complete search history.

(56) References Cited

U.S. PATENT DOCUMENTS

2014/0020693 A1* 1/2014 Cochand ..... A61M 11/041 131/273
2015/0128967 A1* 5/2015 Robinson ..... A24F 40/50 131/328

(Continued)

FOREIGN PATENT DOCUMENTS

EP 2468117 6/2012
EP 3536176 9/2019

(Continued)

OTHER PUBLICATIONS

International Search Report and Written Opinion for International Application No. PCT/GB2020/050935, dated Jul. 10, 2020, 12 pages.

(Continued)

*Primary Examiner* — Katelyn W Smith
(74) *Attorney, Agent, or Firm* — Burr & Forman

(57) ABSTRACT

Disclosed is a vapour provision system comprising a vaporiser for generating vapour from a vapour precursor material and a reservoir for storing vapour precursor material. The vapour provision system further comprises control circuitry configured to supply a first, non-zero level of power to the vaporiser to generate vapour from at least a portion of vapour precursor material, determine a depletion condition of the vapour precursor material based on monitoring a parameter (such as resistance) indicative of a quantity of at least a portion of the vapour precursor material and comparing the monitored parameter to a first threshold; when the control circuitry determines there is depletion based on the comparison between the monitored parameter and the first threshold, supply a second, non-zero level of power to the vaporiser, the second level of power being lower than the first level of power.

16 Claims, 4 Drawing Sheets

(56) References Cited

U.S. PATENT DOCUMENTS

| | | | | |
|---|---|---|---|---|
| 2017/0135406 | A1 | 5/2017 | Reevell | |
| 2018/0325182 | A1* | 11/2018 | Zitzke | H05B 1/0297 |
| 2019/0269176 | A1* | 9/2019 | Dahlmann | A24F 40/51 |

FOREIGN PATENT DOCUMENTS

| | | | | |
|---|---|---|---|---|
| GB | 2558806 | A | 7/2018 | |
| KR | 201060081741 | A | 7/2006 | |
| KR | 2018012474 | A | 11/2018 | |
| WO | WO 2016/169119 | A1 | 10/2016 | |
| WO | WO 2018/019533 | A8 | 2/2018 | |
| WO | WO-2018019533 | A1 * | 2/2018 | A24F 40/40 |

OTHER PUBLICATIONS

Office Action issued in Israeli Patent Application No. 287011 on Apr. 7, 2024, all enclosed pages cited.

Notice to File a Response (with translation) issued in Korean Patent Application No. 10-2021-7035839 on Aug. 14, 2024, all enclosed pages cited.

Office Action issued in New Zealand Patent Application No. 802845 on Mar. 10, 2025, all enclosed pages cited.

Office Action issued in Mexican Patent Application No. MX/a/2021/012280 on Feb. 11, 2025, all enclosed pages cited.

Communication Pursuant to Article 94(3) EPC from corresponding European Application No. 20721681.3, mailed Dec. 23, 2025, all pages cited in its entirety.

Substantive Examination Adverse Report from corresponding Malaysian Application No., PI2023004559, mailed Oct. 21, 2025, all pages cited in its entirety.

* cited by examiner

VAPOR PROVISION SYSTEM AND CORRESPONDING METHOD

CROSS-REFERENCE TO RELATED APPLICATIONS

This application is a National Phase entry of PCT Application No. PCT/GB2020/050935, filed Apr. 9, 2020, which application claims the benefit of priority to GB 1905250.5 filed Apr. 12, 2019, the entire disclosures of which are incorporated herein by reference.

FIELD

The present disclosure relates to vapor provision systems such as nicotine delivery systems (e.g. electronic cigarettes and the like).

BACKGROUND

Electronic vapor provision systems such as electronic cigarettes (e-cigarettes) generally contain a vapor precursor material, such as a reservoir of a source liquid containing a formulation, typically including nicotine, or a solid material such as a tobacco-based product, from which a vapor is generated for inhalation by a user, for example through heat vaporization. Thus, a vapor provision system will typically comprise a vapor generation chamber containing a vaporizer, e.g. a heating element, arranged to vaporize a portion of precursor material to generate a vapor in the vapor generation chamber. As a user inhales on the device and electrical power is supplied to the vaporizer, air is drawn into the device through inlet holes and into the vapor generation chamber where the air mixes with the vaporized precursor material and forms a condensation aerosol. There is a flow path between the vapor generation chamber and an opening in the mouthpiece so the incoming air drawn through the vapor generation chamber continues along the flow path to the mouthpiece opening, carrying some of the vapor/condensation aerosol with it, and out through the mouthpiece opening for inhalation by the user. Some electronic cigarettes may also include a flavor element in the flow path through the device to impart additional flavors. Such devices may sometimes be referred to as hybrid devices and the flavor element may, for example, include a portion of tobacco arranged in the air path between the vapor generation chamber and the mouthpiece so that vapor/condensation aerosol drawn through the devices passes through the portion of tobacco before exiting the mouthpiece for user inhalation.

Problems can arise with such vapor provision systems if there is no longer sufficient vapor precursor material adjacent the heating element (sometimes known as the vapor provision system running dry). This can happen, for example, because the supply of vapor precursor material to the heating element is running out. In that event, rapid over-heating in and around the heating element can occur. Having regard to typical operating conditions, the overheated sections might be expected to quickly reach temperatures up to 500 to 900° C. Not only does this rapid heating potentially damage components within the vapor provision system itself, it may also adversely affect the vaporization process of any residual precursor material. For example, the excess heat may cause the residual precursor material to decompose, for example through pyrolysis, which can potentially release unpleasant tasting substances into the air stream to be inhaled by a user. Unpleasant tasting substances, or the like, may also be released from over heating other components of the aerosol provision device, such as the wick in some liquid vapor precursor systems.

Various approaches are described which seek to help address some of these issues.

SUMMARY

According to a first aspect of certain embodiments there is provided a vapor provision system comprising: a vaporizer for generating vapor from a vapor precursor material; a reservoir storing vapor precursor material; and control circuitry configured to: supply a first, non-zero level of power to the vaporizer to generate vapor from at least a portion of vapor precursor material; determine a depletion condition of the vapor precursor material based on monitoring a parameter indicative of a quantity of at least a portion of the vapor precursor material and comparing the monitored parameter to a first threshold; and in response to the control circuitry determining there is depletion based on the comparison between the monitored parameter and the first threshold, supply a second, non-zero level of power to the vaporizer, the second level of power being lower than the first level of power.

According to a second aspect of certain embodiments there is provided a control circuitry, for use in a vapor provision system for generating a vapor from a vapor precursor material, the vapor provision system comprising a vaporizer for generating vapor from a precursor material, wherein the control circuitry is configured to supply a first, non-zero level of power to the vaporizer to generate vapor from at least a portion of vapor precursor material; determine a depletion condition of the vapor precursor material based on monitoring a parameter indicative of a quantity of at least a portion of the vapor precursor material; compare the monitored parameter to a first threshold; and when the circuitry determines there is depletion based on the comparison between the monitored parameter and the first threshold, supply a second, non-zero level of power to the vaporizer, the second level of power being lower than the first level of power.

According to a third aspect of certain embodiments there is provided a vapor provision device comprising the control circuitry according to the second aspect.

According to a fourth aspect of certain embodiments there is provided a method of operating control circuitry for a vapor provision system comprising a vaporizer for generating vapor from a vapor precursor material and a reservoir storing vapor precursor material, wherein the method comprises: supplying, via the control circuitry, a first, non-zero level of power to the vaporizer to generate vapor from at least a portion of vapor precursor material; determining, via the control circuitry, a depletion condition of the vapor precursor material based on monitoring a parameter indicative of a quantity of at least a portion of the vapor precursor material and comparing the monitored parameter to a first threshold; and in response to the circuitry determining there is depletion based on the comparison between the monitored parameter and the first threshold, supplying, via the control circuitry, a second, non-zero level of power to the vaporizer, the second level of power being lower than the first level of power.

According to a fifth aspect of certain embodiments there is provided a vapor provision system comprising: vaporizing means for generating vapor from a vapor precursor material; storage means for storing vapor precursor material; and control means configured to: supply a first, non-zero level of power to the vaporizing means to generate vapor from at least a portion of vapor precursor material; determine a depletion condition of the vapor precursor material based on monitoring a parameter indicative of a quantity of at least a portion of the vapor precursor material and comparing the monitored parameter to a first threshold; and in response to the control means determining there is depletion based on the comparison between the monitored parameter and the first threshold, supply a second, non-zero level of power to the vaporizing means, the second level of power being lower than the first level of power.

It will be appreciated that features and aspects of the disclosure described above in relation to the first and other aspects of the disclosure are equally applicable to, and may be combined with, embodiments of the disclosure according to other aspects of the disclosure as appropriate, and not just in the specific combinations described above.

BRIEF DESCRIPTION OF THE DRAWINGS

Embodiments of the disclosure will now be described, by way of example only, with reference to the accompanying drawings, in which.

DETAILED DESCRIPTION

Figure 1:
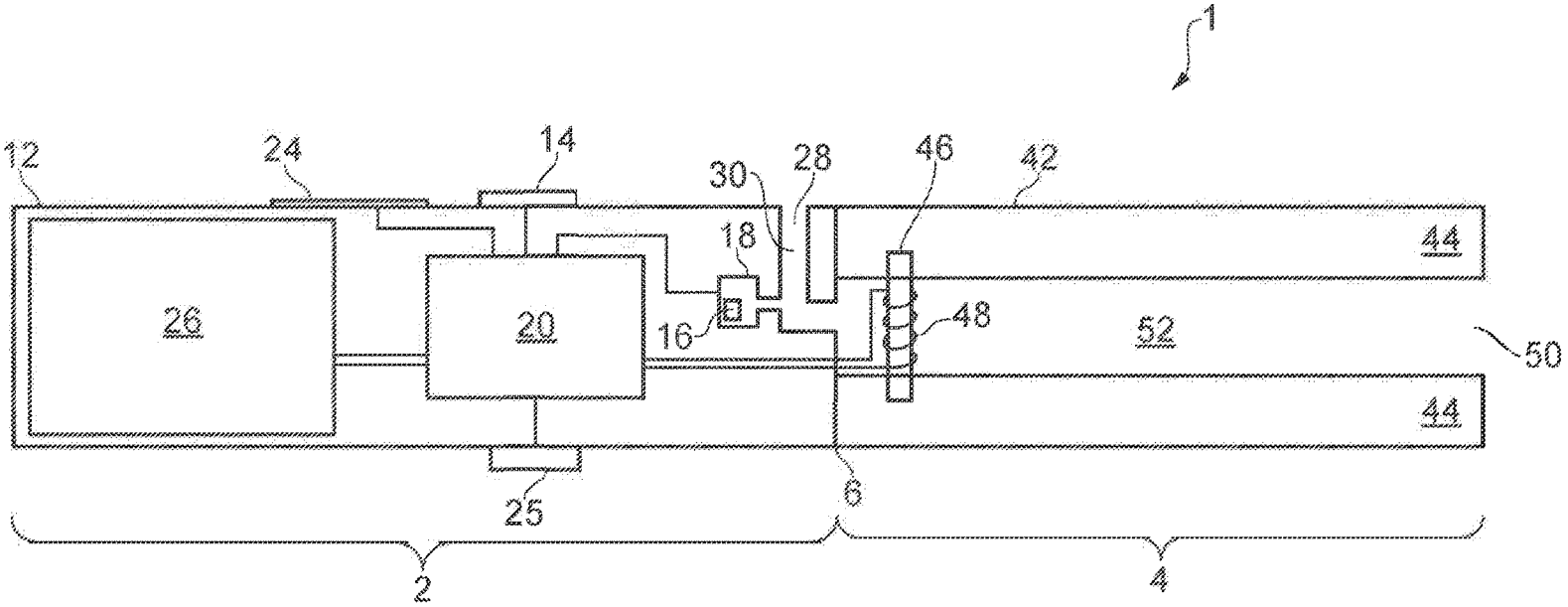
FIG. 1 represents in highly schematic cross-section a vapor provision system in accordance with certain embodiments of the disclosure.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to vapor provision systems, which may also be referred to as aerosol provision systems, such as e-cigarettes, including hybrid devices. Throughout the following description the term "e-cigarette" or "electronic cigarette" may sometimes be used, but it will be appreciated this term may be used interchangeably with vapor provision system/device and electronic vapor provision system/device. Furthermore, and as is common in the technical field, the terms "vapor" and "aerosol", and related terms such as "vaporize", "volatilize" and "aerosolize", may generally be used interchangeably.

Vapor provision systems (e-cigarettes) often, though not always, comprise a modular assembly including both a reusable part and a replaceable (disposable) cartridge part. Often the replaceable cartridge part will comprise the vapor precursor material and the vaporizer and the reusable part will comprise the power supply (e.g. rechargeable battery), activation mechanism (e.g. button or puff sensor), and control circuitry. However, it will be appreciated these different parts may also comprise further elements depending on functionality. For example, for a hybrid device the cartridge part may also comprise the additional flavor element, e.g. a portion of tobacco, provided as an insert ("pod"). In such cases the flavor element insert may itself be removable from the disposable cartridge part so it can be replaced separately from the cartridge, for example to change flavor or because the usable lifetime of the flavor element insert is less than the usable lifetime of the vapor generating components of the cartridge. The reusable device part will often also comprise additional components, such as a user interface for receiving user input and displaying operating status characteristics.

For modular systems a cartridge and reusable device part are electrically and mechanically coupled together for use, for example using a screw thread, latching, friction-fit, or bayonet fixing with appropriately engaging electrical contacts. When the vapor precursor material in a cartridge is exhausted, or the user wishes to switch to a different cartridge having a different vapor precursor material, a cartridge may be removed from the device part and a replacement cartridge attached in its place. Systems conforming to this type of two-part modular configuration may generally be referred to as two-part devices or multi-part devices.

It is relatively common for electronic cigarettes, including multi-part devices, to have a generally elongate shape and, for the sake of providing a concrete example, certain embodiments of the disclosure described herein will be taken to comprise a generally elongate multi-part system employing disposable cartridges containing liquid vapor precursor material. However, it will be appreciated the underlying principles described herein may equally be adopted for different electronic cigarette configurations, for example single-part devices or modular devices comprising more than two parts, refillable devices and single-use disposable devices, and hybrid devices which have an additional flavor element, such as a tobacco pod insert, situated along the air flow path and upstream of the vaporizer, as well as devices conforming to other overall shapes, for example based on so-called box-mod high performance devices that typically have a more box-like shape. More generally, it will be appreciated certain embodiments of the disclosure are based on electronic cigarettes that are configured to provide activation functionality in accordance with the principles described herein, and the specific constructional aspects of electronic cigarette configured to provide the described activation functionality are not of primary significance.

FIG. 1 is a cross-sectional view through an example e-cigarette 1 in accordance with certain embodiments of the disclosure. The e-cigarette 1 comprises two main components, namely a reusable part 2 and a replaceable/disposable cartridge part 4.

In normal use the reusable part 2 and the cartridge part 4 are releasably coupled together at an interface 6. When the cartridge part is exhausted or the user simply wishes to switch to a different cartridge part, the cartridge part may be removed from the reusable part and a replacement cartridge part attached to the reusable part in its place. The interface 6 provides a structural, electrical and air path connection between the two parts and may be established in accordance with conventional techniques, for example based around a screw thread, latch mechanism, or bayonet fixing with appropriately arranged electrical contacts and openings for establishing the electrical connection and air path between the two parts as appropriate. The specific manner by which the cartridge part 4 mechanically mounts to the reusable part 2 is not significant to the principles described herein, but for the sake of a concrete example is assumed here to comprise a latching mechanism, for example with a portion of the cartridge being received in a corresponding receptacle in the reusable part with cooperating latch engaging elements (not represented in FIG. 1). It will also be appreciated the interface 6 in some implementations may not support an electrical connection between the respective parts. For example, in some implementations a vaporizer may be provided in the reusable part rather than in the cartridge part, or alternatively the transfer of electrical power from the reusable part to the cartridge part may be wireless (e.g. based on electromagnetic induction), so that an electrical connection between the reusable part and the cartridge part is not necessary.

The cartridge part 4 may in accordance with certain embodiments of the disclosure be broadly conventional. In FIG. 1, the cartridge part 4 comprises a cartridge housing 42 formed of a plastics material. The cartridge housing 42 supports other components of the cartridge part and provides the mechanical interface 6 with the reusable part 2. The cartridge housing is generally circularly symmetric about a longitudinal axis along which the cartridge part couples to the reusable part 2. In this example the cartridge part has a length of around 4 cm and a diameter of around 1.5 cm. However, it will be appreciated the specific geometry, and more generally the overall shapes and materials used, may be different in different implementations.

Within the cartridge housing 42 is a reservoir 44 that contains liquid vapor precursor material. The liquid vapor precursor material may be conventional, and may be referred to as e-liquid. The liquid reservoir 44 in this example has an annular shape with an outer wall defined by the cartridge housing 42 and an inner wall that defines an air path 52 through the cartridge part 4. The reservoir 44 is closed at each end with end walls to contain the e-liquid. The reservoir 44 may be formed in accordance with conventional techniques, for example it may comprise a plastics material and be integrally moulded with the cartridge housing 42.

The cartridge part further comprises a wick (vapor precursor transport element) 46 and a heating element (vaporizer) 48 located towards an end of the reservoir 44 opposite to the mouthpiece outlet 50. In this example the wick 46 extends transversely across the cartridge air path 52 with its ends extending into the reservoir 44 of e-liquid through openings in the inner wall of the reservoir 44. The openings in the inner wall of the reservoir are sized to broadly match the dimensions of the wick 46 to provide a reasonable seal against leakage from the liquid reservoir into the cartridge air path without unduly compressing the wick, which may be detrimental to its fluid transfer performance.

The wick 46 and heating element 48 are arranged in the cartridge air path 52 such that a region of the cartridge air path 52 around the wick 46 and heating element 48 in effect defines a vaporization region for the cartridge part. E-liquid in the reservoir 44 infiltrates the wick 46 through the ends of the wick extending into the reservoir 44 and is drawn along the wick by surface tension/capillary action (e.g., wicking). The heating element 48 in this example comprises an electrically resistive wire coiled around the wick 46. The heating element 48 may be formed from any suitable metal or electrically conductive material which exhibits a change in resistance with temperature. In this example the heating element 48 comprises a nickel iron alloy (e.g., NF60) wire and the wick 46 comprises a cotton fibre bundle.

In one example, the heating element 48 comprises a nickel iron alloy wire having a thickness (of the wire) of between 0.17 mm to 0.20 mm (e.g., 0.188 mm±0.02 mm) and a length of between 55 mm to 65 mm (e.g., 60.0 mm±2.5 mm). The wire is formed into a helical coil having an axial length of between 4.0 to 6.0 mm (e.g., 5.00 mm±0.5 mm), and having an outer diameter of between 2.2 mm to 2.7 mm (e.g., 2.50 mm±0.2 mm). The coil in this example is formed to have 9 turns, and has a turn pitch of 0.67±0.2 per mm. The resistance of the coil, in a non-powered state and measured at room temperature (e.g., 25°) is between 1.1 to 1.6 Ohms, more specifically 1.4 Ohms±0.1 Ohms. As described in more detail below, the power supplied to the heating element 48 is set to be between 6.0 and 6.5 Watts. The wick 46 in the example described is formed of an organic cotton (although alternative implementations may use a glass fibre bundle). The wick is formed into an approximately cylindrical structure having a length of between 15 mm to 25 mm (e.g., 20.00±2.0 mm), having a diameter of between 2 to 5 mm (e.g., 3.5 mm+1.0 mm/−0.5 mm). The organic cotton fibres are twisted together at 40±5 twist/m. Such an arrangement provides for an e-liquid absorption of between 0.2 g to 0.5 g (e.g., 0.3 g±0.05 g) and an absorbing time of 65 s±10 s. Note that during formation, the wick 46 is partially located in the inner volume defined by the helical coil.

In another example, the heating element 48 comprises a nickel iron alloy wire having a thickness (of the wire) of between 0.14 mm to 0.18 mm (e.g., 0.16 mm±0.02 mm) and a length of between 37 mm to 47 mm (e.g., 43.0 mm±2.5 mm). The wire is formed into a helical coil having an axial length of between 3.0 to 5.0 mm (e.g., 4.00 mm±0.5 mm), and having an outer diameter of between 2.2 mm to 2.7 mm (e.g., 2.50 mm±0.2 mm). The coil in this example is formed to have 7 turns, and has a turn pitch of 0.67±0.2 per mm. The resistance of the coil, in a non-powered state and measured at room temperature (e.g., 25°) is between 1.1 to 1.6 Ohms, more specifically 1.4 Ohms±0.1 Ohms. As above, the power supplied to the heating element 48 is set to be between 6.0 and 6.5 Watts. The wick 46 in the example described is also formed of an organic cotton (although alternative implementations may use a glass fibre bundle). The wick is formed into an approximately cylindrical structure having a length of between 12 mm to 18 mm (e.g., 15.00±2.0 mm), having a diameter of between 2 to 5 mm (e.g., 3.5 mm+1.0 mm/−0.5 mm). The organic cotton fibres are twisted together at 40±5 twist/m. Such an arrangement provides for an e-liquid absorption of between 0.2 g to 0.5 g (e.g., 0.3 g±0.05 g) and an absorbing time of 65 s±10 s. As above, the wick 46 is partially located in the inner volume defined by the helical coil.

However, it will be appreciated the specific vaporizer configuration is not significant to the principles described herein, and the above limitations are provided by way of a concrete example.

In use electrical power may be supplied to the heating element 48 to vaporize an amount of e-liquid (vapor precursor material) drawn to the vicinity of the heating element 48 by the wick 46. Vaporized e-liquid may then become entrained in air drawn along the cartridge air path from the vaporization region through the cartridge air path 52 and out the mouthpiece outlet 50 for user inhalation.

Broadly, the rate at which e-liquid is vaporized by the vaporizer (heating element) 48 during normal use will depend on the amount (level) of power supplied to the heating element 48 during use. Thus electrical power can be applied to the heating element 48 to selectively generate vapor from the e-liquid in the cartridge part 4, and furthermore, the rate of vapor generation can be changed by changing the amount of power supplied to the heating element 48, for example through pulse width or frequency modulation techniques. However, as discussed in greater detail below, one factor that can influence the rate or amount of vaporization is the quantity of vapor precursor material in the vicinity of the heating element 48.

The reusable part 2 comprises an outer housing 12 with an opening that defines an air inlet 28 for the e-cigarette, a battery 26 for providing operating power for the electronic cigarette, control circuitry 20 for controlling and monitoring the operation of the electronic cigarette, a user input button 14, an inhalation sensor (puff detector) 16, which in this example comprises a pressure sensor located in a pressure sensor chamber 18, and a visual display 24. The reusable part 2 of FIG. 1 also comprises an indicator 25, although the indicator 25 is optional and may not be included in other implementations.

The outer housing 12 may be formed, for example, from a plastics or metallic material and in this example has a circular cross-section generally conforming to the shape and size of the cartridge part 4 so as to provide a smooth transition between the two parts at the interface 6. In this example, the reusable part has a length of around 8 cm so the overall length of the e-cigarette when the cartridge part and reusable part are coupled together is around 12 cm. However, and as already noted, it will be appreciated that the overall shape and scale of an electronic cigarette implementing an embodiment of the disclosure is not significant to the principles described herein.

The air inlet 28 connects to an air path 30 through the reusable part 2. The reusable part air path 30 in turn connects to the cartridge air path 52 across the interface 6 when the reusable part 2 and cartridge part 4 are connected together. The pressure sensor chamber 18 containing the pressure sensor 16 is in fluid communication with the air path 30 in the reusable part 2 (e.g., the pressure sensor chamber 18 branches off from the air path 30 in the reusable part 2). Thus, when a user inhales on the mouthpiece opening 50, there is a drop in pressure in the pressure sensor chamber 18 that may be detected by the pressure sensor 16 and also air is drawn in through the air inlet 28, along the reusable part air path 30, across the interface 6, through the vapor generation region in the vicinity of the atomiser 48 (where vaporized e-liquid becomes entrained in the air flow when the vaporizer is active), along the cartridge air path 52, and out through the mouthpiece opening 50 for user inhalation.

The battery 26 in this example is rechargeable and may be of a conventional type, for example of the kind normally used in electronic cigarettes and other applications requiring provision of relatively high currents over relatively short periods. The battery 26 may be recharged through a charging connector in the reusable part housing 12, for example a USB connector.

The user input button 14 in this example is a conventional mechanical button, for example comprising a spring mounted component which may be pressed by a user to establish an electrical contact. In this regard, the input button may be considered to provide a manual input mechanism for the terminal device, but the specific manner in which the button is implemented is not significant. For example, different forms of mechanical button or touch-sensitive button (e.g. based on capacitive or optical sensing techniques) may be used in other implementations. The specific manner in which the button is implemented may, for example, be selected having regard to a desired aesthetic appearance.

The display 24 is provided to give a user a visual indication of various characteristics associated with the electronic cigarette, for example current power setting information, remaining battery power, and so forth. The display may be implemented in various ways. In this example the display 24 comprises a conventional pixilated LCD screen that may be driven to display the desired information in accordance with conventional techniques. In other implementations the display may comprise one or more discrete indicators, for example LEDs, that are arranged to display the desired information, for example through particular colours and/or flash sequences. More generally, the manner in which the display is provided and information is displayed to a user using the display is not significant to the principles described herein. Some embodiments may not include a visual display and may include other means for providing a user with information relating to operating characteristics of the electronic cigarette, for example using audio signalling or haptic feedback, or may not include any means for providing a user with information relating to operating characteristics of the electronic cigarette.

The control circuitry 20 is suitably configured/programmed to control the operation of the electronic cigarette to provide functionality in accordance with embodiments of the disclosure as described further herein, as well as for providing conventional operating functions of the electronic cigarette in line with the established techniques for controlling such devices. The control circuitry (processor circuitry) 20 may be considered to logically comprise various sub-units/circuitry elements associated with different aspects of the electronic cigarette's operation in accordance with the principles described herein and other conventional operating aspects of electronic cigarettes, such as display driving circuitry and user input detection. It will be appreciated the functionality of the control circuitry 20 can be provided in various different ways, for example using one or more suitably programmed programmable computer(s) and/or one or more suitably configured application-specific integrated circuit(s)/circuitry/chip(s)/chipset(s) configured to provide the desired functionality.

The vapor provision system 1 of FIG. 1 is shown comprising a user input button 14 and an inhalation sensor 16. In the described implementation of FIG. 1, the control circuitry 20 is configured to receive signalling from the inhalation sensor 16 and to use this signalling to determine if a user is inhaling on the electronic cigarette and also to receive signalling from the input button 14 and to use this signalling to determine if a user is pressing (e.g., activating) the input button. These aspects of the operation of the electronic cigarette (e.g., puff detection and button press detection) may in themselves be performed in accordance with established techniques (for example using conventional inhalation sensor and inhalation sensor signal processing techniques and using conventional input button and input button signal processing techniques). The control circuitry 20 is configured to supply power to the heating element 48 if the control circuitry 20 determines that a user is inhaling on the electronic cigarette or that the user is pressing the input button 14. However, in other implementations, it should be appreciated that only one of the puff sensor 16 or user input button 14 is provided for the purposes of causing vaporization of the e-liquid.

The indicator 25 described above is configured to output a signal to the user indicating a specific state of the vapor provision system 1. In particular, the indicator is configured to output a signal, to a user, indicative of a depletion condition associated with the vapor provision system 1. The depletion condition is defined herein as a condition of the system indicative of a depletion of the vapor precursor material in the vapor provision system 1. For instance, the depletion condition can be defined with respect to the wick 46. In the event that the amount of e-liquid within the wick falls below a normal operational amount, the vapor provision system can be said to be depleted. The wick 46 may become depleted for a number of reasons, some of which are described in detail below. It should also be understood that the depletion condition may be defined with respect to other components, such as the reservoir 44 of the cartridge part 4.

Referring back to the indicator 25, the indicator 25 may output any suitable signal for indicating, to the user, the depletion condition of the system 1. For example, the signal may be an optical signal (e.g., which is output by an LED or similar light outputting element), a haptic signal (e.g., which is output by a vibrator or the like), or an acoustic signal (e.g., as output by a speaker or the like). Accordingly, the indicator may be any suitable component that is able to output one or more of these signals. For the sake of a concrete example, the indicator 25 of the described implementation of FIG. 1 is an LED configured to output an optical signal in the event that depletion is detected. It should also be appreciated that, in some implementations, a separate indicator 25 may not be provided and instead other components of the aerosol provision system 1 may provide the functionality of the indicator 25. For example, in some implementations, display 24 may be configured to output the signal for indicating depletion. It should also be understood that the indicator 25 may be remote from, or form part of an element that is remote from, the e-cigarette 1 itself. For example, the indicator 25 may be part of a smartphone, or similar remote device, which is configured to communicatively couple (either wireless or wired) to the e-cigarette 1.

Figure 2:
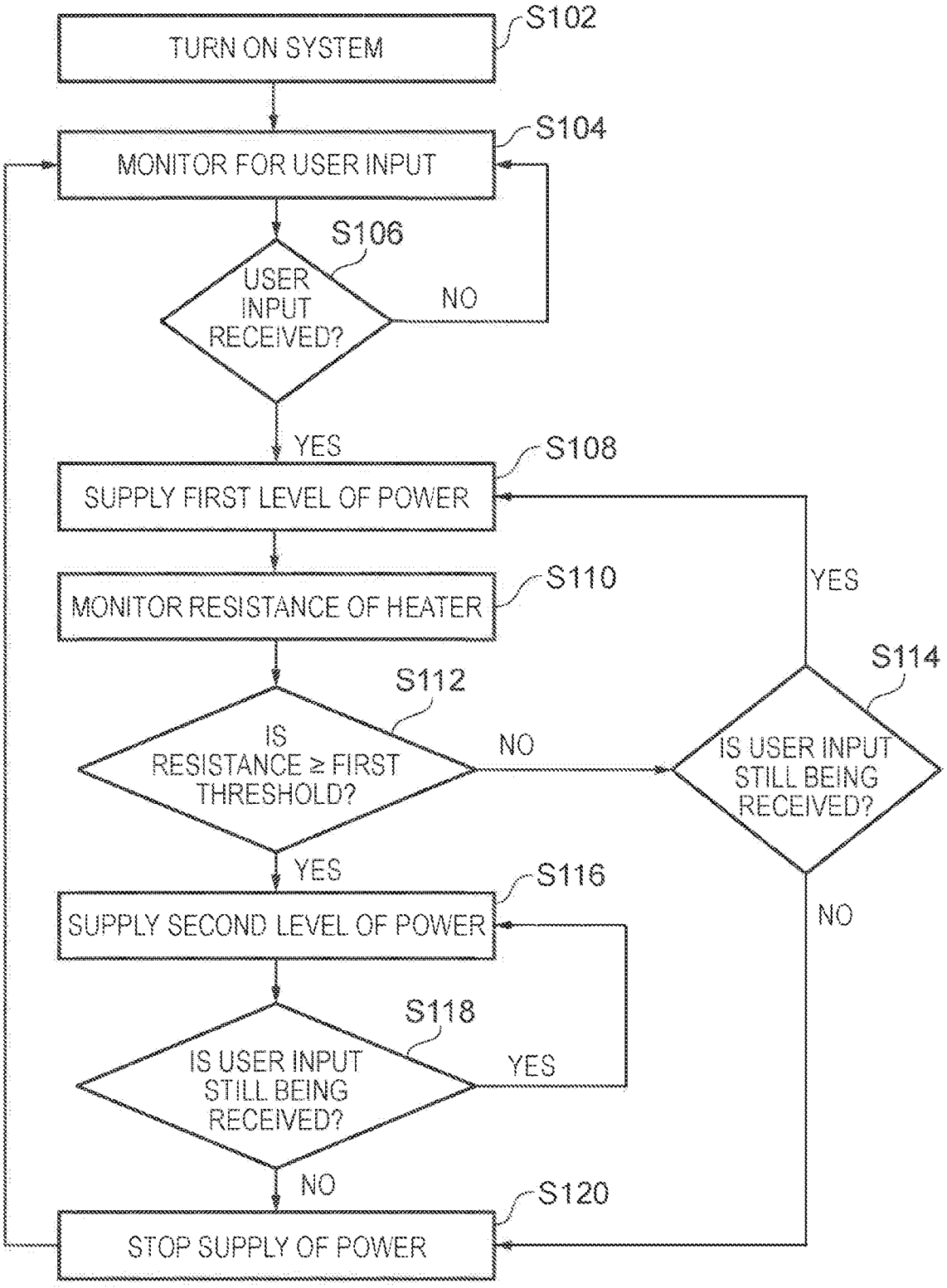
FIG. 2 is a flow diagram representing operating steps for the vapor provision system of FIG. 1 in accordance with a some implementation of the disclosure, wherein the power level is determined once per puff.

As hinted at above, the present disclosure provides a system 1 in which a depletion condition of the vapor provision system 1 can be detected or indicated to a user. FIG. 2 describes a method of operating such a vapor provision system 1, in accordance with aspects of the present disclosure.

FIG. 2 starts at step S102 where a user turns on the vapor provision system 1. The vapor provision system 1 may be turned on in response to a user input. In the implementation of FIG. 1, this is performed by a user actuating the user input button 14. In the example vapor provision system 1 of FIG. 1, to turn on the system 1, the user input button 14 is actuated by the user in accordance with a predefined sequence, e.g., three button presses in quick succession (for example, within 2 seconds). Having a predefined turn on sequence is advantageous when the user input button 14 is used for performing multiple functions, as is the case for the vapor provision system 1 shown in FIG. 1 (and as described below). The same sequence (or an alternative sequence) may also be used to turn off the vapor provision system 1. It should be appreciated that in other implementations a dedicated mechanism turn on/turn off button (or other user input mechanism) may alternatively be employed.

It should be appreciated that the vapor provision system 1 may be in a low power state prior to step S102, such that the control circuitry 20 (or specific parts thereof) are supplied with a low (minimum) level of power in order to perform certain functions, such as monitoring when a user turns on the system 1 using input button 14. In other implementations, the user may turn on the system 1 by physically moving a button (not shown), such as slider button, to complete an electric circuit within control circuitry 20, or between control circuitry 20 and battery 26, thereby causing power to flow to the control circuitry.

Once the system 1 is turned on at step S102, the control circuitry 20 is configured to monitor for a user input (for generating or delivering aerosol to the user) at step S104. As mentioned above, in the described implementation of FIG. 1, the control circuitry 20 is configured to receive signalling from the inhalation sensor 16 and to use this signalling to determine if a user is inhaling on the vapor provision system 1 or to receive signalling from the input button 14 and to use this signalling to determine if a user is pressing (e.g., activating) the input button 14. In the described implementation, the control circuitry 20 is configured to repeatedly determine whether or not a user input is received. For example, the control circuitry 20 may be configured to check periodically, e.g., every 0.5 seconds, to determine whether either (or both) of the input button 14 or inhalation sensor 16 is outputting signalling indicative of a user actuation. In alternative implementations, the signalling output from the input button or inhalation sensor 16 may trigger an action within the control circuitry 20, for example charging a capacitor or as an input to a comparator or the like. That is, the control circuitry 20 may instead be responsive to the signalling and perform an action in response to receiving the signalling. It should be appreciate that either approach (that is, active monitoring or passive reception of signalling) may be implemented in accordance with the principles of the present disclosure.

In FIG. 2, if the control circuitry 20 determines that either the inhalation sensor 16 or the input button 14 is outputting signalling indicative of actuation, the control circuitry 20 determines that a user input indicative of the user's intent to receive aerosol has been received. That is, YES at step S106. Conversely, if the control circuitry 20 determines that no user input indicative of the user's intent to receive aerosol has been received, the method proceeds back to step S104 and the control circuitry 20 continues to monitor for the user input indicative of the user's intent to receive aerosol.

In response to determining that a user input has been received at step S106, the control circuitry 20 is configured to supply a first level of power to the heating element 48 at step S108.

The first level of power is supplied to the heating element 48, which causes the temperature of the heating element 48 to gradually increase up to an operational temperature at which at least a part of the e-liquid held within the wick 46 is vaporized. In general, the amount of power supplied as the first level of power will vary from implementation to implementation, and is likely to vary in accordance with a number of different factors including, but not limited to, the volume of liquid held within the wick, the relative surface area between the heating element and the e-liquid, and the voltage and current characteristics of the heating element. In the example described above in FIG. 1, the first level of power is set such that, in normal use, there is a balance between the power dissipated by the heating element 48 and used to vaporize the e-liquid, and the mass of e-liquid that is to be heated. Because liquid has a phase transition from liquid to, in this case, vapor, energy that is dissipated into the liquid vaporizes the liquid and, broadly speaking, does not further increase the temperature of the liquid. However, there are other factors to take account of, such that only a percentage of the mass of e-liquid is likely to be vaporized, and the remaining e-liquid held in the wick 46 is heated but is not vaporized. This remaining mass acts as a heat sink and absorbs some of the dissipated energy from the heating element 48. In the example vapor provision system 1, a balance is struck between the power supplied to the heating element 48 and the mass of e-liquid held in the wick 46 so as to generate sufficient aerosol without substantially increasing the temperature of the heating element 48. That is, when the e-liquid in the wick 46 is sufficiently replenished, the temperature of the heating element will, within a certain tolerance, be approximately constant during normal use (and after an initial warm-up period).

It has been found that for an example system 1 such as that described above in which the heating element is a nickel iron alloy wire a resistance of between 1.3 to 1.5 Ohms as measured at room temperature (e.g., 25° C.) and turn pitch of 0.67±0.2 per mm, and the wick is an organic cotton wick having a liquid absorption of between 0.3 g±0.05 g and an absorbing time of 65 s±10 s (as described in the above examples, a suitable power level for such a system is between 6 to 7 Watts, and in some implementations, between 6.0 to 6.5 Watts. The control circuitry 20 may be configured to deliver power to the heating element 48 according to any suitable technique. In some implementations, the control circuitry 20 is configured, when determining there is a user input at step S106, to supply DC power continuously (constantly), from the power source 26 to the heating element 48, possibly via any components such as a DC to DC boost converter to adjust the electrical characteristics (e.g., voltage) of the supplied power if necessary. In other implementations, a modulation technique, such as pulse width modulation, PWM, may be used. In these implementations, pulses of power are supplied to the heating element 48. PWM supplies pulses in accordance with a certain duty cycle which, broadly speaking, is the ratio between the pulse width and the period of the signal waveform. In these implementations, the first level of power supplied in step S108 may be considered to be the average (RMS) power supplied over one duty cycle (e.g., the power provided by the pulse multiplied by the quotient of the duration of the pulse over the duration of the duty cycle). Typical duty cycles may be on the order of 40 ms or less (note that having a duty cycle too great may cause fluctuations in the temperature of the heating element).

As shown in FIG. 2, when the control circuitry 20 supplies the first level of power at step S108, the control circuitry 20 is also configured to monitor a parameter associated with depletion condition of the vapor provision system 1. In the example of FIG. 2, the control circuitry 20 is configured to monitor the electrical resistance of the heating element 48. The electrical resistance of the heating element 48 is a parameter that is indicative of the depletion condition of the wick 46. This is because, as the wick 46 depletes, the temperature of the heating element 48, and thus its electrical resistance, increases due to the fact that less e-liquid is available to vaporize or absorb the dissipated power from the heating element 48.

In terms of the system used by the control circuitry 20 to monitor the resistance of the heating element 48, the process of measuring the resistance of the heating element 48 may be performed in accordance with conventional resistance measurement techniques. That is to say, the control circuitry 20 may comprise a resistance-measuring component that is based on established techniques for measuring resistance (or a corresponding electrical parameter). In one implementation, the control circuitry 20 comprises a reference resistor (not shown), of a known resistance value, connected in series with the heating element 48 (the reference resistor may be provided in the device part 2 rather than cartridge part 4). The control circuitry 20 comprises a switching arrangement, including one or more FETs, which act to selectively couple the reference resistor to the control circuitry 20 (and more particular, to ground). A signal line is coupled between the reference resistor and the heating element 48 and feeds into a voltage measuring component of the control circuitry 20. When the reference resistor is coupled to the heating element 48, the voltage along the signal line is indicative of the voltage over the heating element 48. In this way, potential divider equations can be used to infer the resistance of the heating element 48, based on the known resistance of the reference resistor and the input voltage to the heating element 48. However, it should be appreciated that this is merely one way for determining the resistance, and any other suitable technique for determining the resistance across the heating element may also be used in accordance with the principles of the present disclosure.

The control circuitry 20 may be arranged to sample the resistance periodically (e.g., every 50 ms) when supplying the first level of power to the heating element 48. In alternative implementations, the control circuitry 20 may continuously monitor the resistance, e.g., using a comparator into which the voltage signal (or a derived resistance signal) is fed. In either case, the control circuitry 20 is configured to repeatedly determine/derive or measure the resistance value of the heater element 48.

At step S112, the control circuitry 20 is configured to compare the resistance of the heating element against a first threshold. Specifically, the control circuitry 20 is configured to determine whether the resistance of the heating element 48 is greater than or equal to the first threshold. Note that depending on the value of the first threshold and the specific way in which the control circuitry 20 is set up, alternative implementations of the control circuitry may determine whether the resistance value is simply greater than the first threshold.

In the vapor provision system 1 described above in which a heating element 48 is Ohmically heated via passing a current through the electrically conductive heating element 48, the resistance of the heating element 48 generally increases with temperature. In some instances, resistance and temperature may be approximately linear. Hence, the resistance of the heating element 48 is proportional to the temperature of the heating element 48.

The heating element 48 will generally have a room-temperature resistance value and an operational resistance value (e.g., a value at which the heating element reaches operational temperature). For example, in the system described above, the operational resistance value is approximately 2.1 Ohms. The first threshold is set at a value greater than the operational resistance value, e.g., at least 5% greater. In the example above, this equates to a value around 2.21 Ohms. The first threshold is set to a value great enough such that slight variations in the temperature of the heating element 48 caused by oscillating around the operational temperature are ignored, but not too great that the temperature of the heating element 48 increases significantly. For instance, a resistance value of 2.21 Ohms in the above example corresponds to a temperature increases of approximately 10 to 20° C. (to a total temperature of around 210 to 220° C.) as compared to an operational temperature (of around 200° C.). The first threshold may be defined as a fixed resistance value, e.g., 2.21 Ohms, which is pre-stored in a memory of the control circuitry 20, or the first threshold may be calculated based on a previous measurement of the resistance of the heating element (e.g., a previous reading plus a fixed resistance value, or a previous reading plus a certain percentage, e.g., 14%, of the previous reading). The previous reading may be determined, e.g., at the start of the puff, and so approximate the operational resistance value of the heating element.

At step S112, if the control circuitry 20 determines that the resistance of the heating element 48 is less than the first threshold (e.g., NO at step S112), then the method proceeds to step S114.

At step S114, the control circuitry 20 determines whether or not there is still a user input indicative of the user's intent to generate aerosol. In normal use, the user will inhale on the system 1 or press the input button 14 for as long as they want to receive aerosol, which is usually around 3 seconds. In other words, in this implementation, the user controls the start and stop of aerosol generation. The control circuitry 20 determines whether or not signalling from the input button 14 or the inhalation sensor 16 indicating activation of one or both of the input button 14 or the inhalation sensor 16 is being received. If it is, e.g., YES at step S114, the method proceeds back to step S108 and the control circuitry 20 continues to supply the first level of power to the heating element 48. The method then proceeds to steps S110 and S112 as described above. Hence, the control circuitry 20 repeatedly (or cyclically) determines whether the resistance of the heating element 48 is greater than or equal to the first threshold when the first level of power is being supplied.

If, on the other hand, the user input is no longer being received, e.g., NO at step S114, the method proceeds to step S120 where the supply of power to the heating element 48 is stopped. When the user input is no longer being received, this indicates that the user has stopped inhaling on system 1 or has stopped pushing the input button 14, and thus no longer wishes to receive aerosol. That is to say, the user has finished that puff/inhalation. Accordingly, when the control circuitry 20 detects this, the supply of power to the heating element 48 is stopped such that aerosol is no longer actively generated by the system 1. The method proceeds back to step S104, and the control circuitry 20 subsequently monitors for the next user input, signifying the user's desire to receive aerosol (e.g., the start of the next puff).

In accordance with aspects of the present disclosure, when, at step S112, the resistance of the heating element 48 is greater than or equal to the first threshold (e.g., YES at step S112), the method proceeds to step S116 where the control circuitry 20 is configured to deliver a second level of power (instead of the first level of power) to the heating element 48. In other words, when the temperature of the heating element 48 is such that the resistance exceeds the first threshold, a reduced power is supplied to the heating element 48. The second level of power is less than the first level of power, but is a non-zero level of power. In other words, the control circuitry supplies a non-zero level of power to the heating element 48 as the second level of power. As described, the power supplied to the heating element 48 is controlled by the control circuitry 20, e.g., via PWM control. The control circuitry 20 is therefore configured to vary the level of power supplied to the heating element 48 using any suitable techniques, such as PWM control (by varying the duty cycle) or by decreasing the magnitude of the voltage supplied to the heating element.

As described above, it should be appreciated that, during normal use, a certain quantity of e-liquid held within the wick 46 is vaporized and inhaled by the user. In normal conditions, and in particular when there is sufficient e-liquid within the reservoir 44, the wick 46 is sufficiently replenished with e-liquid such that the wick 46 holds an approximately constant amount of e-liquid. Assuming there is sufficient e-liquid to be vaporized, the power dissipated by the heating element is absorbed into the e-liquid and vaporized. At this time, the temperature of the e-liquid is approximately constant. In addition, in the event there is more e-liquid than can be vaporized, the remaining e-liquid acts as a heat sink and absorbs some of the dissipated power raising the temperature of, but not vaporizing, the remaining e-liquid.

However, when the amount of liquid in the wick 46 decreases below the constant amount, e.g., due to the reservoir 44 running out of e-liquid and therefore being unable to replenish the wick 46, then not as much of the dissipated power can be absorbed by the e-liquid. In some instances, the power is transferred to the material of the wick 46, or other materials of the cartridge part 4, which do not have a similar phase change characteristics as the e-liquid. As a result, may cause the wick and heating element 48 to continue to increase in temperature, which could lead to charring of the wick 46 amongst other undesirable effects that may impact the taste of the aerosol generated or cause damage to the vapor provision system 1. That is to say, as the e-liquid in the wick 46 depletes, there is a greater proportion of the energy dissipated by the heating element 48 not being transferred to e-liquid (and instead, e.g., to the wicking material of the wick 46).

In practical terms however, that is not to say that the wick 46 is completely devoid of any e-liquid. In some systems which detect a dry wick prematurely, it is likely that this e-liquid remaining in the wick is never vaporized, despite the fact there may be a sizable amount of e-liquid to vaporize. Thus, consumers needlessly dispose of cartridge parts containing e-liquid that could possibly be vaporized and inhaled. This is inefficient in terms of material usage, which may lead to greater costs to consumers and moreover, increased waste to be disposed of.

In accordance with the present disclosure, at step S112, when the resistance (and thus temperature) of the heating element 48 is equal to or greater than the first threshold, the control circuitry 20 determines that the system 1 is depleted, and more particularly that there is depletion of e-liquid within the wick 46. Note that in step S112, when comparing the resistance value to the first threshold, the control circuitry 20 may be said to be determining a depletion condition associated with the vapor provision system 1 (e.g., whether or not the system 1 is depleted).

Accordingly, as shown at step S116, the control circuitry 20 supplies a second, reduced level of power to the heating element 48. As compared to supplying the first level of power, for a given mass of e-liquid in the wick 46, the second level of power reduces the temperature at which the heating element 48 may reach for that given amount of e-liquid (based on the balance between energy dissipated and the mass of e-liquid available to receive the dissipated energy). In practice, this may not necessarily means that the temperature of the heating element drops below the operational temperature, and in some implementations, the second level of power is selected such that the temperature does not drop below the operational temperature. Rather, because there is less mass of e-liquid available to vaporize, the power that is to be dissipated is reduced. Subsequently, this means it is less likely for the heating element 48 to substantially exceed the operational, and thus char the wicking material, for example. In this regard, although the control circuitry 20 determines that there is depletion of the e-liquid stored within the wick 46, the vapor provision system 1 is nevertheless able to generate vapor from the remaining e-liquid which the user can inhale and would otherwise have lost, while also reducing the possibility of overheating the e-liquid or wicking material.

The second level of power may be set to be 70% or less than the first level of power, or 50% or less than the first level of power, or 30% or less than the first level of power. The precise value may depend on several factors, including the difference between the first threshold and the operational resistance value of the heating element 48.

Referring back to FIG. 2, at step S118, the control circuitry 20 is configured to determine whether or not there is still a user input indicative of the user's intent to generate aerosol. As described above in relation to step S114, the control circuitry 20 determines whether or not signalling from the input button 14 or the inhalation sensor 16 indicating activation of one or both of the input button 14 or the inhalation sensor 16 is being received. If it is, e.g., YES at step S118, the method proceeds back to step S116 and the control circuitry 20 continues to supply the second level of power to the heating element 48. Hence, the control circuitry 20 continually monitors whether the user input is still being received or not when supplying the second level of power to the heating element 48.

If, on the other hand, the user input is no longer being received, e.g., NO at step S118, the method proceeds to step S120 where the supply of power to the heating element 48 is stopped, as described above. The method proceeds back to step S104, and the control circuitry 20 monitors for the next user input, signifying the user's desire to receive aerosol.

As described, the present disclosure provides for a vapor provision system 1 in which the resistance of the heating element 48 is compared against a first threshold to determine whether or not there is depletion e-liquid within at least a part of the system, and in particular within the wick. In the event that depletion is detected (which, in the described implementation, corresponds to an increase in temperature or resistance of the heating element 48), a reduced level of power is supplied to the heating element. The reduced level of power is supplied such that aerosol may still be generated from the e-liquid that remains in the wick 46, but in a manner that reduces the chances of damaging the cartridge part 4 (and in particular the wick or heating element). This improves the usage efficiency of the e-liquid within the cartridge part 4 and subsequently permits users to use more of the e-liquid supplied with the cartridge part 4. This can reduce the number of times the user may be required to switch the cartridge part 4, compared to other modular systems.

It should be appreciated that when the control circuitry supplies the second, reduced level of power to the heating element 48, the quantity of aerosol generated (or rather, of liquid vaporized) may be reduced as compared to when the control circuitry 20 supplies the first level of power. Depending on the differences in quantity, this may be noticeable to a user, e.g., when the user exhales the inhaled aerosol. In some instances, this may be sufficient for the user to appreciate that the reservoir 44 is becoming depleted and thus it is likely that cartridge part 4 will require changing shortly. The change in aerosol amount can thus act as a prompt for the user to take the necessary actions.

In instances where the change in quantity of generated aerosol is not noticeable, or to reinforce this change to a user, when the control circuitry 20 determines there is depletion at step S112, the control circuitry 20, in some implementations such as that described in FIG. 1, is also configured to activate indicator 25. As mentioned previously, the indicator 25 can be used to output a signal, such as an optical signal via an LED, to indicate to a user that depletion has been detected. In much the same way as above, the indicator 25 can act as a prompt for the user to take the necessary actions in terms of replacing the cartridge part 4. More specifically, in implementations where the indicator 25 is used, the control circuitry is configured to activate the indicator simultaneously with step S116 of FIG. 2. The control circuitry 20 may turn off the indicator at step S120, or the indicator 25 may continue to be activated until the user performs an action that is detected by the control circuitry 20, e.g., such as swapping cartridge part 4 for another cartridge part 4. The indicator 25 may output a continuous signal, e.g., a continuous light signal, or an intermittent signal, e.g., a series of light pulses. In either case, the indicator 25 provides a signal that informs the user that depletion of the liquid within the wick (or more generally that depletion within the vapor provision system 1) has been detected.

It should also be appreciated that enabling the user to vaporize the remaining e-liquid using the second level of power not only increases the amount of e-liquid that can be used, but additionally provides the user with the option to continue to inhale aerosol even when it is not possible for the user to change the cartridge part 4, e.g., when driving. Even though the amount of aerosol generated might be slightly less, the user is still provided with some aerosol. Hence, the combination of a warning of depletion (either via a noticeable change in aerosol quantity or via the indicator 25) with the ability to generate vapor even in the event that depletion within the system 1 has been detected, enables the user to take the necessary actions, or plan their vaping activities, accordingly.

Although it has been described above that the control circuitry 20 determines whether a user input is still being received or not (at steps S114 and S118), these steps may be omitted. For example, in some implementations, when the control circuitry 20 determines that a user input has been received at step S106, power is configured to be supplied to the heating element for a predetermined time period from the detection of a user input. For example, power may be supplied for a time period that is approximately equal to a typical puff duration, e.g., three seconds. After the predetermined time period has expired, the power supply to the heating element 48 may be stopped. It should be appreciated that in these implementations, the control circuitry 20 may still be configured to supply different levels of power depending on whether or not the resistance value of the heating element 48 is above or below the first threshold, but instead of determining whether the user input is received, the control circuitry 20 is configured to determine whether or not the predetermined time period has elapsed.

In the described implementation of FIG. 2, the control circuitry 20 is configured to supply the second level of power in response to detecting that depletion has occurred. The second level of power is supplied for as long as there is a user input still being input (step S118), for any given puff. Once the supply of power to the heating element 48 has been stopped (at step S120), e.g., at the end of a given puff, the method proceeds back to step S104 and the control circuitry monitors for a user input. In subsequent puffs, the control circuitry 20 supplies a first level of power according to step S108 before supplying a second level of power at step S116. This approach may be beneficial for some applications, particular where the wick 46 may be considered to be depleted of e-liquid (based on the resistance of the heating element 48) but the reservoir 44 may not be fully depleted. For example, some users may use the vapor provision system 1 such that it is tilted from a normal use angle (e.g., when the user is lying down). In these instances, the ends of the wick 46 located in the reservoir 44 may not be in contact with the e-liquid in the reservoir 44 and hence vaping in this orientation may mean the wick 46 is considered to be depleted but the reservoir 44 is not considered to be depleted. In response to the user receiving the indication from indicator 25, or the reduced volume of aerosol, the user may tilt the system 1 such that the ends of the wick 46 come back into contact with the e-liquid in the reservoir 44. Hence, the determination of whether or not there is depletion for any given puff is effectively reset between puffs.

Moreover, in accordance with FIG. 2, assuming depletion has been determined and the control circuitry supplies the second level of power, once a user finishes that puff, for the start of the next puff the control circuitry 20 supplies the first level of power to the heating element 48. This may be advantageous if the heating element 48 is at a low temperature, e.g., this can be used to quickly ramp up the temperature of the heating element to the operational temperature, even if there is a small amount of e-liquid held in the wick 46.

In the example of FIG. 2, the determination of whether or not there is depletion for any given puff is effectively reset between puffs. Once a positive determination of depletion has been made at step S112, the control circuitry 20 may therefore not continue to monitor the resistance of the heating element 48 once a determination has been made that the resistance of the heating element 48 is greater than or equal to the first threshold. This may save power that would otherwise be used to monitor and compare the resistance during a puff.

Figure 3:
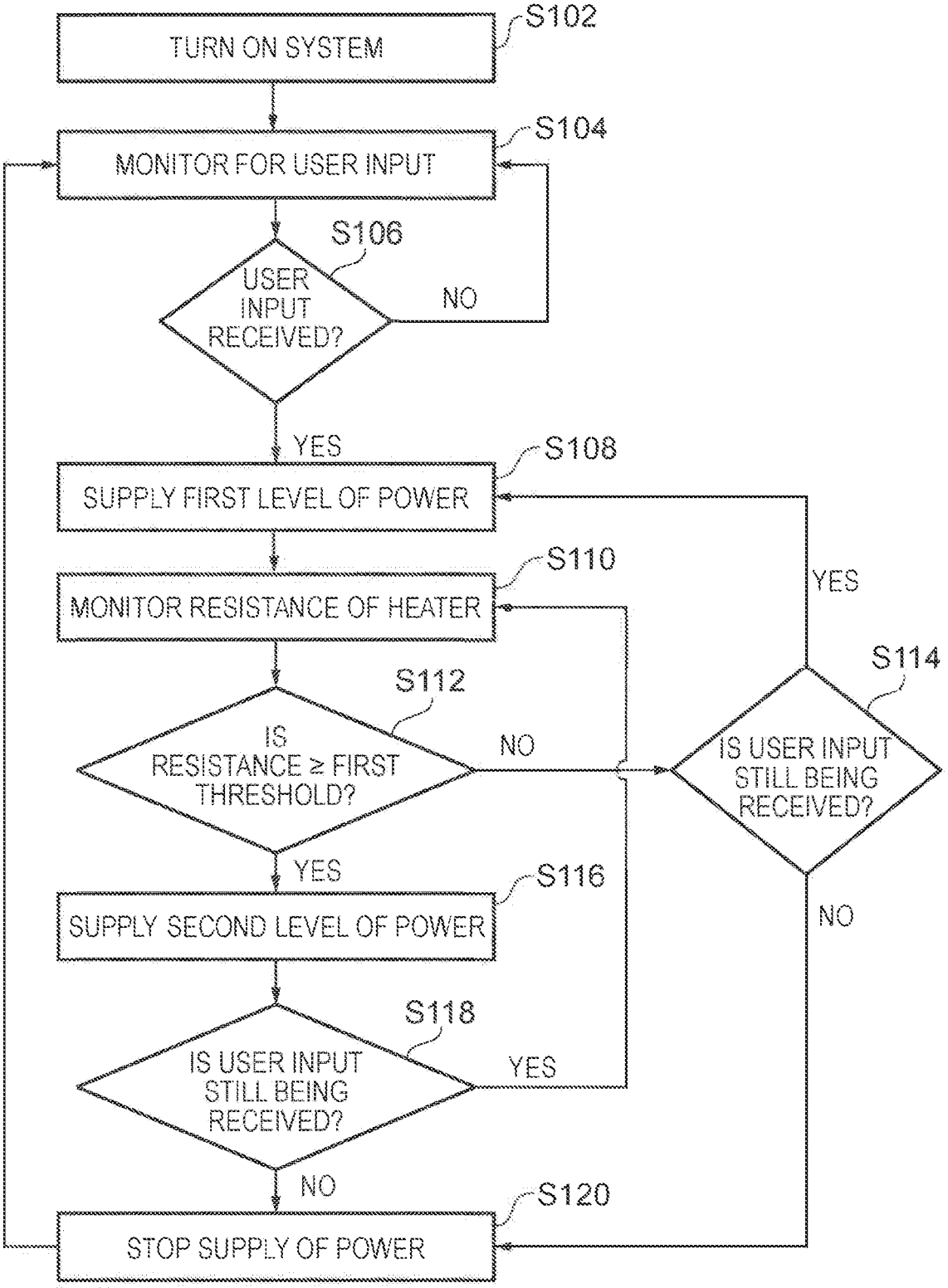
FIG. 3 is a flow diagram representing operating steps for the vapor provision system of FIG. 1 in accordance with a further implementation of the disclosure, wherein the power level can be determined multiple times per puff.

However, in some implementations, it may be beneficial to adjust the power multiple times during a puff to accommodate more rapid changes in the depletion condition of the vapor provision system 1. FIG. 3 shows a further example method of operating a vapor provision system 1 of FIG. 1, in accordance with further aspects of the present disclosure, whereby the power level can be adjusted multiple times during a given puff. The method of FIG. 3 is broadly similar to that of FIG. 2, and a repetition of the various steps, etc. which are common to FIG. 3 (as indicated by common reference signs) will be omitted for brevity. Only the differences will be described in detail.

In FIG. 2, at step S118, if the user input is still being received, then the control circuitry 20 is configured to supply the second level of power to the heater element 48. However, in FIG. 3, if the user input is still being received at step S118, e.g., YES at step S118, the method proceeds back to step S112. That is, the control circuitry 20 is configured to monitor the resistance of the heating element 48 while the user input is being received. In this regard, it should be understood that FIG. 3 describes a system 1 in which the resistance of the heater element 48 is repeatedly compared with the first threshold during a given inhalation, regardless of whether the control circuitry 20 supplies the first level or the second level of power to the heater element 48. In some implementations, a predetermined delay (e.g., of 10-20 milliseconds) between step S118 and S110 may be imposed in order to allow the resistance value of the heating element 48 to adjust in response to the second power level being applied.

Providing control circuitry 20 configured in this way means that more rapid changes in the depletion condition of the wick 46 can be accounted for and a suitable power level can be supplied accordingly.

In an alternative example based on FIG. 2 but not shown, to reduce the chance of charring of the wick, when the control circuitry 20 determines there is depletion at step S112, the control circuitry 20 is configured to store or record, in a memory or the like, an indication that depletion has been detected. Subsequently, prior to supplying any power in a subsequent puff, the control circuitry 20 determines whether during the last puff depletion was detected, and if so, to begin supplying the second level of power. This arrangement may be advantageous in the event that the depletion is from the depletion of the reservoir in addition to the wick 46, and not just a depletion of the wick 46.

Figure 4:
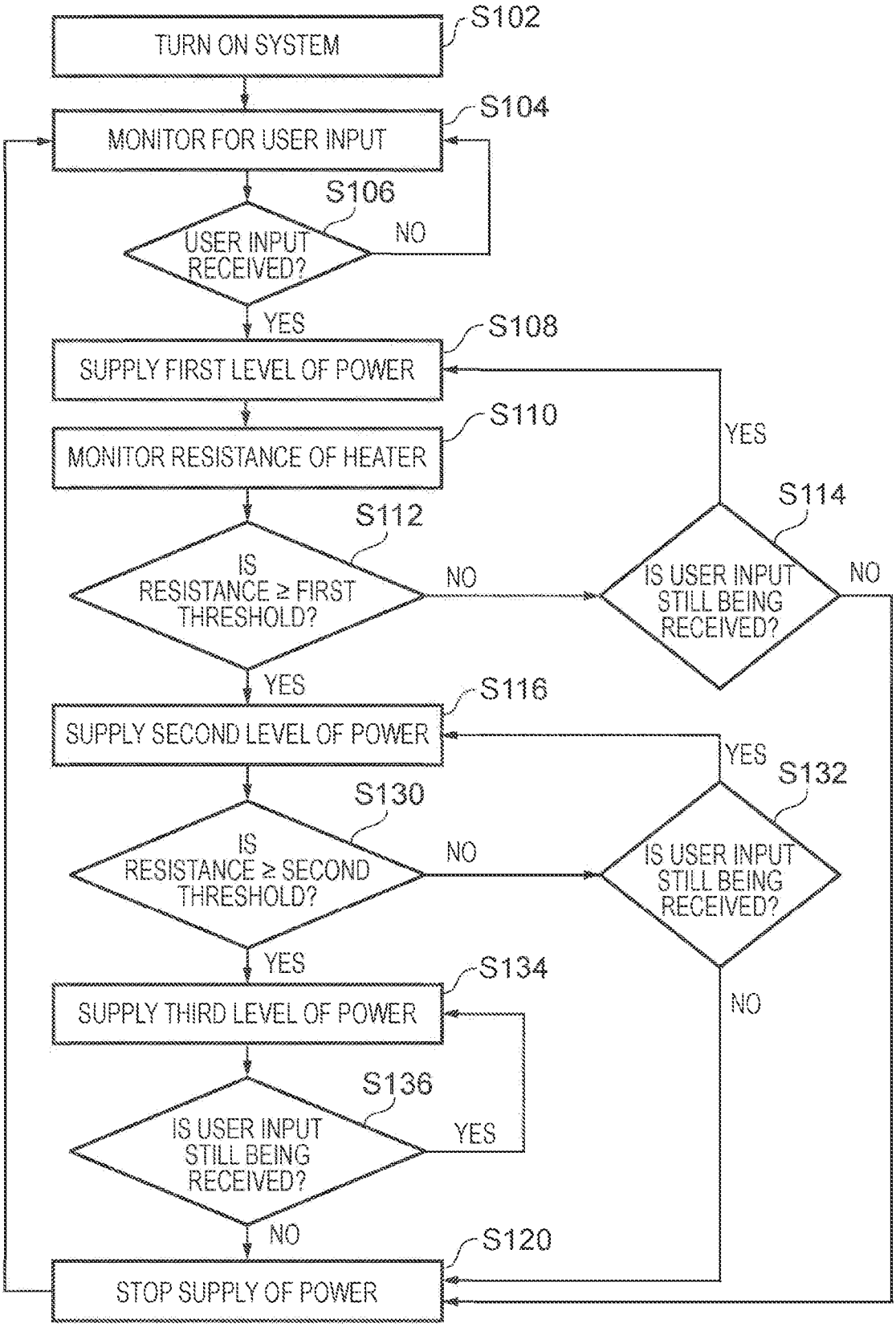
FIG. 4 is a flow diagram representing operating steps for the vapor provision system of FIG. 1 in accordance with yet a further implementation of the disclosure, wherein multiple power levels can be determined per puff.

FIG. 4 is a further example of a method of operating a vapor provision system 1 of FIG. 1, in accordance with further aspects of the present disclosure, whereby the power level can be adjusted during a given puff. The method of FIG. 4 is broadly similar to that of FIG. 2, and a repetition of the various steps etc. which are common to FIG. 4 (as indicated by common reference signs) will be omitted for brevity. Only the differences will be described in detail.

In broad summary, FIG. 4 exemplifies a system 1 where the control circuitry 20 is configured to select one of multiple (three) power levels to supply to the heating element 48; that is a first power level, a second power level lower than the first power level, and a third power level lower than the second power level. Such a system offers the potential to vaporize even more of the e-liquid remaining within the wick 46, but continually stepping down the power level supplied to the heating element 48. The principles of operation are broadly the same as described with respect to FIG. 2, with the exception of a further power level.

At step S116, when it is determined previously that the monitored resistance of the heating element 48 is greater than or equal to a first threshold at step S112, the method proceeds to step S130. At step 130, the monitored resistance of the heating element 48 is compared to a second threshold. In some implementations, the second threshold is the same as the first threshold, given that the resistance of the heating element 48 is proportional to the temperature of the heating element 48, and in which case the system 1 is configured such that the heating element 48 is operated to reach the same or similar temperature during use. That is, taking the values used in conjunction with FIG. 2, the first and second thresholds are set to 2.21 Ohms. In other implementations, the second threshold may be set slightly lower than the first threshold, e.g., less than 10% of the first threshold. In this way, the maximum temperature of the heating element 48 is further limited when the second level of power is applied, which might be advantageous if the system 1 experiences sudden significant changes in the mass of e-liquid remaining in the wick. However, in other implementations, the second threshold may be set differently than the first threshold, particularly in implementations where the heating characteristics of the heating element 48 differ based on the amount of e-liquid held in the wick 46.

At step S130, the control circuitry 20 is configured to determine whether the resistance is greater than or equal to the second threshold. Note that depending on the value of the second threshold, alternative implementations of the control circuitry may determine whether the measured or determined resistance value is greater than the second threshold. At step S130, if the control circuitry 20 determines that the resistance of the heating element 48 is less than the second threshold (e.g., NO at step S130), then the method proceeds to step S132.

At step S132, the control circuitry 20 determines whether or not there is still a user input indicative of the user's intent to generate aerosol. In normal use, the user will inhale on the system 1 or press the input button 14 for as long as they want to receive aerosol, which is usually around 3 seconds. In other words, in this implementation, the user controls the start and stop of aerosol generation. The control circuitry 20 determines whether or not signalling from the input button 14 or the inhalation sensor 16 indicating activation of one or both of the input button 14 or the inhalation sensor 16 is being received. If it is, e.g., YES at step S132, the method proceeds back to step S116 and the control circuitry 20 continues to supply the second level of power to the heating element 48. The method then proceeds to steps S130 as described above. Hence, the control circuitry 20 repeatedly (or cyclically) determines whether the resistance of the heating element 48 is greater than or equal to the second threshold when the second level of power is being supplied.

If, on the other hand, the user input is no longer being received, e.g., NO at step S132, the method proceeds to step S120 where the supply of power to the heating element 48 is stopped. When the user input is no longer being received, this indicates that the user has stopped inhaling on system 1 or has stopped pushing the input button 14, and thus no longer wishes to receive aerosol. Accordingly, when the control circuitry 20 detects this condition, the supply of power to the heating element 48 is stopped such that aerosol is no longer generated. The method proceeds back to step S104, and the control circuitry 20 monitors for the next user input, signifying the user's desire to receive aerosol.

In accordance with aspects of the present disclosure, when, at step S130, the resistance of the heating element 48 is greater than or equal to the second threshold (e.g., YES at step S112), the method proceeds to step S134 where the control circuitry 20 is configured to deliver a third level of power (instead of the second level of power) to the heating element 48. In other words, when the temperature of the heating element 48 is such that the resistance exceeds the second threshold, a further reduced power is supplied to the heating element 48. The third level of power is less than the second level of power, but is a non-zero level of power. In other words, the control circuitry supplies a non-zero level of power to the heating element 48 as the third level of power.

The third level of power may be set to be 70% or less than the second level of power, or 50% or less than the second level of power, or 30% or less than the second level of power. The precise value may depend on several factors, including the difference between the second threshold and the operational resistance value of the heating element 48.

In much the same way as before, the control circuitry 20 determines whether the user input is still being received at step S136, e.g., as in step S114 or S132. If it is, the method proceeds back to step S134 and the third level of power is continued to be applied by the control circuitry 20 to the heating element 48. Conversely, if the user input is not still being received at step S136, the method proceeds to step S120 and the power supply to the heating element 48 is stopped.

In the method of operation described by FIG. 4, the control circuitry 20 is configured to compare the resistance of the heating element 48 to a plurality of thresholds, each corresponding to a certain power level to be supplied to the heating element 48. Providing multiple power levels enables a finer control on the power that is supplied to the heating element 48. In one example, the power can be varied across the puff so that a suitable level of power is applied to the heating element 48 to accommodate the change in the amount of e-liquid held within the wick.

The principles of FIG. 4 can be incorporated with those of FIG. 3. Equally, the principles of FIG. 4 can be applied to systems in which the power level of a previous puff is recorded and subsequent puffs begin at the previously recorded power level. Furthermore, it should be appreciated that while only three power levels have been described in the context of FIG. 4, more than three power levels may be adopted in accordance with the principles of the present disclosure. Each of the plurality of power levels are set so as to have sequentially decreasing values, but each of the power levels are non-zero power levels.

While the above has described systems 1 which seek to measure the resistance of a heating element 48 to determine the depletion condition, it should be appreciated that any other suitable technique may be used to determine depletion. For example, infrared cameras can be used to measure the temperature of the heating element 48. An analogous process of comparing the temperature to threshold(s) can be implemented in such a scenario. Additionally, depletion may be determined by monitoring parameters associated with the reservoir 44, for example a time of flight sensor may be used to monitor the liquid level within the reservoir 44. In principle, any suitable technique for determining the depletion of the e-liquid in a part of the vapor provision system (such as the wick 46 or reservoir 44) can be employed in accordance with the principles of the present disclosure.

Although it has been described above that the vapor provision system 1 comprises a sealed cartridge part 4, it should be appreciated that the cartridge part 4 may be re-fillable in some implementations. The principles of the present disclosure apply equally to such implementations. In yet further implementations, the cartridge part 4 may be an integral part of the reusable device part 2, e.g., formed as one component or at the very least sharing aspects of the housing. The integrated cartridge part 4 is re-fillable with e-liquid. Such arrangements of vapor provision systems may be known as open systems. The principles of the present disclosure apply equally to such implementations.

While the above-described embodiments have in some respects focussed on some specific example vapor provision systems, it will be appreciated the same principles can be applied for vapor provision systems using other technologies. That is to say, the specific manner in which various aspects of the vapor provision system function are not directly relevant to the principles underlying the examples described herein.

For example, whereas the above-described embodiments have primarily focused on devices having an electrical heater based vaporizer for heating a liquid vapor precursor material, the same principles may be adopted in accordance with vaporizers based on other technologies, for example piezoelectric vibrator based vaporizers or optical heating vaporizers, and also devices based on other vapor precursor materials, for example solid materials, such as plant derived materials, such as tobacco derivative materials, or other forms of vapor precursor materials, such as gel, paste or foam based vapor precursor materials.

Furthermore, and as already noted, it will be appreciated the above-described approaches in connection with an electronic cigarette may be implemented in cigarettes having a different overall construction than that represented in FIG. 1. For example, the same principles may be adopted in an electronic cigarette which does not comprise a two-part modular construction, but which instead comprises a single-part device, for example a disposable (e.g., non-rechargeable and non-refillable) device. Furthermore, in some implementations of a modular device, the arrangement of components may be different. For example, in some implementations the control unit may also comprise the vaporizer with a replaceable cartridge providing a source of vapor precursor material for the vaporizer to use to generate vapor. Furthermore still, whereas in the above-described examples the electronic cigarette 1 does not includes a flavor insert, other example implementations may include such an additional flavor element.

Equally, while the above systems have been described in respect of liquid vapor precursor materials, similar principles can be applied to vapor precursor materials of a different state of matter. For instance, some solids, such as recon tobacco may exhibit characteristic changes in their thermal properties as the material is vaporized. In the event such materials do, then the techniques of the present disclosure may equally be applied to these materials.

Thus there has been described a vapor provision system comprising: a vaporizer for generating vapor from a vapor precursor material; a reservoir storing vapor precursor material; and control circuitry configured to: supply a first, non-zero level of power to the vaporizer to generate vapor from at least a portion of vapor precursor material; determine a depletion condition of the vapor precursor material based on monitoring a parameter indicative of a quantity of at least a portion of the vapor precursor material and comparing the monitored parameter to a first threshold; and when the control circuitry determines there is depletion based on the comparison between the monitored parameter and the first threshold, supply a second, non-zero level of power to the vaporizer, the second level of power being lower than the first level of power.

In order to address various issues and advance the art, this disclosure shows by way of illustration various embodiments in which the disclosure may be practiced. The advantages and features of the disclosure are of a representative sample of embodiments only, and are not exhaustive and/or exclusive. They are presented only to assist in understanding and to teach the disclosure. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other embodiments not presently claimed, but which may be claimed in future.

The invention claimed is:

1. A vapor provision system comprising:

a vaporizer comprising an electrically heated heating element for generating vapor from a vapor precursor material;

a reservoir storing vapor precursor material; and control circuitry configured to:

(a) supply a first, non-zero level of power to the vaporizer to generate vapor from at least a portion of vapor precursor material;

(b) determine the electrical resistance of the heating element used to generate said vapor;

(c) determine a depletion condition of the vapor precursor material based on monitoring a parameter indicative of a quantity of at least a portion of the vapor precursor material, wherein the monitored parameter is the determined electrical resistance of the heating element, and comparing the monitored parameter to a plurality of thresholds, including a first threshold, wherein each of the thresholds is indicative of a different degree of depletion of the at least a portion of the vapor precursor material; and (d) subsequent to (c), in response to the control circuitry determining there is depletion based on the comparison between the monitored parameter and the first threshold, (i) begin supplying a second, non-zero level of power to the vaporizer instead of the first, non-zero level of power, the second level of power being lower than the first level of power, and (ii) begin comparing the monitored parameter to a second threshold;

(e) subsequent to (d), in response to the control circuitry determining there is depletion based on the comparison between the monitored parameter and the second threshold, (i) begin supplying a third non-zero level of power to the vaporizer instead of the second, non-zero level of power, the third level of power being lower than the second level of power, and wherein each of the thresholds corresponds to one of a plurality of different non-zero power levels configured to be output by the control circuitry.

2. The vapor provision system of claim 1, wherein the second level of power is less than 70% of the first level of power.

3. The vapor provision system of claim 1, wherein the second level of power is set such that the vapor provision system can continue to generate vapor even after the control circuitry determines there is depletion of the at least a portion of the vapor precursor material.

4. The vapor provision system of claim 1, wherein the control circuitry is configured to supply power to the vaporizer using pulse width modulation, and wherein the first and second power levels are an average power over one duty cycle of the pulse width modulation.

5. The vapor provision system of claim 1, wherein the system further comprises an indicator, and wherein the control circuitry is configured to activate the indicator when the control circuitry determines that there is depletion based on the comparison between the monitored parameter and the first threshold.

6. The vapor provision system of claim 1, wherein the system further comprises a vapor precursor transport element configured to transport the vapor precursor material from the reservoir to the vaporizer.

7. The vapor provision system of claim 6, wherein the depletion condition of the vapor precursor material is an indication of the quantity of vapor precursor material within the vapor precursor transport element.

8. The vapor provision system of claim 1, wherein the control circuitry is configured to repeatedly compare the monitored parameter to the first threshold.

9. The vapor provision system of claim 1, wherein, when the control circuitry supplies the second level of power to the vaporizer, the control circuitry is configured to compare the monitored parameter to the first threshold and supply the first level of power when the control circuitry determines there is no longer depletion based on the comparison between the monitored parameter and the first threshold.

10. The vapor provision system of claim 1, wherein the depletion condition of the vapor precursor material is an indication of the quantity of vapor precursor material within the reservoir.

11. The vapor provision system of claim 1, wherein the second level of power is less than 50% of the first level of power.

12. The vapor provision system of claim 1, wherein the second level of power is less than 30% of the first level of power.

13. A control circuitry, for use in a vapor provision system for generating a vapor from a vapor precursor material, the vapor provision system comprising a vaporizer comprising an electrically heated heating element for generating vapor from a precursor material, wherein the control circuitry is configured to:

supply a first, non-zero level of power to the vaporizer to generate vapor from at least a portion of vapor precursor material;

determine the electrical resistance of the heating element used to generate said vapor;

determine a depletion condition of the vapor precursor material based on monitoring a parameter indicative of a quantity of at least a portion of the vapor precursor material, wherein the monitored parameter is the determined electrical resistance of the heating element;

compare the monitored parameter to a plurality of thresholds, including a first threshold, wherein each of the thresholds is indicative of a degree of depletion of the at least a portion of the vapor precursor material; and in response to the circuitry determining there is depletion based on the comparison between the monitored parameter and the first threshold, begin supplying a second, non-zero level of power to the vaporizer instead of the first, non-zero level of power, the second level of power being lower than the first level of power, and wherein once the control circuitry determines there is depletion on the basis of the first threshold, the control circuitry is configured to compare the monitored parameter to a second threshold;

in response to the circuitry determining there is a depletion based on the comparison between the monitored parameter and the second threshold, begin supplying a third non-zero level of power to the vaporizer, the third level of power being lower than the second level of power, wherein each of the thresholds corresponds to one of a plurality of different non-zero power levels configured to be output by the control circuitry.

14. The control circuitry of claim 13, wherein the depletion condition of the vapor precursor material is an indication of the quantity of vapor precursor material within the reservoir.

15. A method of operating control circuitry for a vapor provision system comprising a vaporizer comprising an electrically heated heating element for generating vapor from a vapor precursor material and a reservoir storing vapor precursor material, wherein the method comprises:

(a) supplying, via the control circuitry, a first, non-zero level of power to the vaporizer to generate vapor from at least a portion of vapor precursor material;

(b) determine the electrical resistance of the heating element used to generate said vapor;

(c) determining, via the control circuitry, a depletion condition of the vapor precursor material based on monitoring a parameter indicative of a quantity of at least a portion of the vapor precursor material, wherein the monitored parameter is the determined electrical resistance of the heating element, and comparing the monitored parameter to a plurality of thresholds, including a first threshold, wherein each of the thresholds is indicative of a respective degree of depletion of the at least a portion of the vapor precursor material; and (d) subsequent to (c), in response to the circuitry determining there is depletion based on the comparison between the monitored parameter and the first threshold, (i) supplying, via the control circuitry, a second, non-zero level of power to the vaporizer, the second level of power being lower than the first level of power instead of the first, non-zero level of power, and (ii) wherein once the control circuitry determines there is depletion on the basis of the first threshold, the control circuitry is configured to begin comparing the monitored parameter to a second threshold; and (e) subsequent to (d), in response to the control circuitry determining there is depletion based on the comparison between the monitored parameter and the second threshold, (i) begin supplying a third non-zero level of power to the vaporizer, the third level of power being lower than the second level of power, wherein each of the thresholds corresponds to one of a plurality of different non-zero power levels configured to be output by the control circuitry.

16. The method of claim 15, wherein the depletion condition of the vapor precursor material is an indication of the quantity of vapor precursor material within the reservoir.

* * * * *